United States Patent [19]

Ura et al.

[11] Patent Number: 4,788,571

[45] Date of Patent: Nov. 29, 1988

[54] RECORDING PAPER FEEDING DEVICE WITH PAPER POSITION REGULATING MEMBER

[75] Inventors: Hiroaki Ura; Takao Shiozawa, both of Hachioji, Japan

[73] Assignee: Konishiroku Photo Industry Co., Ltd., Tokyo, Japan

[21] Appl. No.: 12,008

[22] Filed: Feb. 6, 1987

[30] Foreign Application Priority Data

Feb. 20, 1986 [JP] Japan ..... 61-36731
Mar. 6, 1986 [JP] Japan ..... 61-49081

[51] Int. Cl.[4] ..... G03G 15/00; B65H 5/22; B65H 1/00

[52] U.S. Cl. ..... 355/3 SH; 271/3.1; 271/171

[58] Field of Search ..... 355/14 R, 14 SH, 3 SH; 271/3.1, 30.1, 31, 34, 147, 154, 155, 171, 22

[56] References Cited

U.S. PATENT DOCUMENTS 3,334,893 9/1965 McCall ..... 271/171 X
4,298,270 11/1981 Tsuda et al. ..... 355/3 SH
4,504,053 3/1985 Shiozawa ..... 271/34
4,569,587 2/1986 Miyoshi et al. ..... 355/3 SH X

FOREIGN PATENT DOCUMENTS 113160 9/1979 Japan ..... 271/147

OTHER PUBLICATIONS

Xerox Disclosure Journal, vol. 4, No. 1, Jan./Feb. 1979, p. 69, by Leslie Bernard Hocking.
Xerox Disclosure Journal, Vol, 5, No. 4, Jul./Aug. 1980, p. 381, by Jack R. Oagley.

*Primary Examiner*—A. T. Grimley
*Assistant Examiner*—Ed Pipala
*Attorney, Agent, or Firm*—Frishauf, Holtz, Goodman & Woodward

[57] ABSTRACT

A paper feeding device wherein a backing plate for carrying thereon papers is moved up and down by a lifting device, a rotating device rotates a rear regulating member mounted on the backing plate with respect to the backing plate while the crest of the rear regulating member makes contact with a cover of a paper container when the backing plate is lifted by the lifting device.

14 Claims, 6 Drawing Sheets

RECORDING PAPER FEEDING DEVICE WITH PAPER POSITION REGULATING MEMBER

BACKGROUND OF THE INVENTION

1. Field of the Invention

The present invention relates to a paper feeding device for a variety of image recording apparatus such as copying machines including electrophotographic ones, printers for computer output, or light printers and, more particularly, to a recording paper feeding device with a paper position regulating member, which device can contain a large number of sheets of recording paper supplied and can feed them one by one to a recording unit.

2. Description of the Prior Art

Each image recording apparatus adopts the so-called "cassette type paper feeding system" when various kinds of sheet paper such as ordinary paper, printing paper, photosensitive paper, pressure-sensitive paper, heat-sensitive paper, electrostatic recording paper, transfer paper, or recording sheets of synthetic resin are to be fed to the paper feeding conveyor unit of the recording apparatus body. In the cassette type paper feeding system, the cut paper is contained in the paper feeding cassette, and the cassette receptacle of the apparatus body is charged with the paper feeding cassette so that the cut paper may be fed.

This kind of paper feeding cassette is usually small-sized to have its content limited. In the recording apparatus using a great number of sheets of recording paper and capable of recording at a high speed, the paper feeding cassette raises a defect that the recording apparatus has to be frequently supplied with new recording paper.

In order to cope with the rise in the operating efficiency of the high-speed recording apparatus of the above type in recent years, there has been proposed a paper feeding device which has its efficiency increased by adding a paper feeding stacker having a capacity as large as 1,000 to 2,000 sheets to the paper feeding conveyor unit of the recording apparatus body and by letting off the recording paper generally horizontally by lifting means and paper feeding means disposed at the side of that paper feeding stacker so that a great number of sheets of recording paper may be supplied and conveyed for a long time.

FIG. 8 shows the paper conveyor system of a reproducing machine or the like, which is equipped with a paper feeding stacker of such high capacity (as disclosed in Japanese Patent Publication No. 11663/1985).

In FIG. 8, reference numeral 1 denotes a paper feeding stacker of high capacity for containing a great number of, e.g., 1,000 to 3,000 sheets of paper, and numeral 2 denotes an overlying paper feeding cassette for containing 500 to 1,000 sheets of paper. The sheets of paper are let off one by one from the upper or lower paper feeding unit by a paper feeding roller 3A or 3B. The paper thus let off is then held under pressure between synchronizing rollers 4 to proceed in synchronism with the rotations of a photosensitive drum 5. After this, a toner image is transferred by a transfer electrode 6 to the proceeding paper, which is then delivered to a fixing device 7. In this device 7, the toner on the paper is heated to melt so that it is fixed to the paper. After this, the paper is conveyed by a conveyor belt 8 selectively to a tray 9, a sorter 10 or a both-side copying apparatus (although not shown in the drawing) so that it is discharged to the outside of the body of the copying machine.

The aforementioned large-capacity paper feeding stacker is constructed of lifting means 11, a paper container guide member 12 and a paper container 13. This paper container 13 is equipped inside of its casing with a pair of fixed paper sheaf side regulating members (although not shown in the drawing), a fixed paper front limiting member 14, a fixed paper rear regulating member 15, and a liftable paper sheaf backing plate 16 carrying a sheaf of paper and made movable up and down by the lifting action of the lifting means 11.

The aforementioned paper rear regulating member 15 is a screen or like member anchored at the bottom of the casing of the paper container 13 and having its upper end portion extending to the level of the paper feeding surface of the paper feeding roller 3A.

As the paper feed is started so that the paper sheafs are fed one by one from its uppermost paper, the sheaf has its paper decreased gradually. However, the backing plate 16 is lifted by the lifting means 11, and this lift is so controlled by detecting means that the uppermost level of the paper sheaf may always be maintained at a predetermined paper feed plane.

Here, the leading end portion of the uppermost of the paper sheaf has its level regulated by the paper feeding roller 3A or a separating pawl (although not shown in the drawing). Since, however, the level of the remaining portion of the uppermost part of the paper is not regulated in the least, the uppermost paper may be turned over, pushed back by the paper feeding roller 3A, or advanced obliquely by the oneside feed of the paper feeding roller 3A. As a result, the uppermost paper may ride over the upper end of the paper rear regulating member 15, and the paper sheaf may have uneven rear edges to have sheaf fall to pieces still the worse.

This paper unevenness will invite a deteriorated feed (e.g., no feed or oblique feed) of the paper to cause an abnormal reproduction.

SUMMARY OF THE INVENTION

An object of the present invention is to provide a paper feeding device having a large-capacity paper feeding stacker, which can conduct accurate and reliable paper feeding actions by solving the problems of the paper feeding device having the aforementioned rear regulating member and by regulating and arranging the rear ends of paper at all times.

The above-specified object is achieved by a paper feeding device including a paper container having therein a backing plate which is made movable up and down while carrying a great number of sheets of recording paper, comprising a rear regulating member arranged for regulating the rear end of a sheaf of recording paper carried on said backing plate and enabled to swing around a member integrated with said backing plate. In a preferred embodiment of the present invention, said regulating member is energized to have an upright position by a spring and enabled to be pivoted and fall down when its crest comes into pressure contact with a cover of the body of said paper container.

The above-specified is further achieved by a paper feeding device, in which a rear regulating member for regulating the rear end of the paper sheaf is movably integrated with said backing plate and made movable with respect to a friction member mounted on one end of said backing plate. In a preferred embodiment of the present invention, said friction member is a permanent magnet, and at least a surface of said rear regulating member containing with said permanent magnet is made of a magnetic material. Moreover, when said rear regulating member abuts against an inner wall surface of a casing, in which said regulating member is built, to slidably move, it is frictionally held by said magnet.

Other objects and advantages of the present invention will become apparent from the following description taken with reference to the accompanying drawings.

BRIEF DESCRIPTON OF THE DRAWINGS

Figure 10:
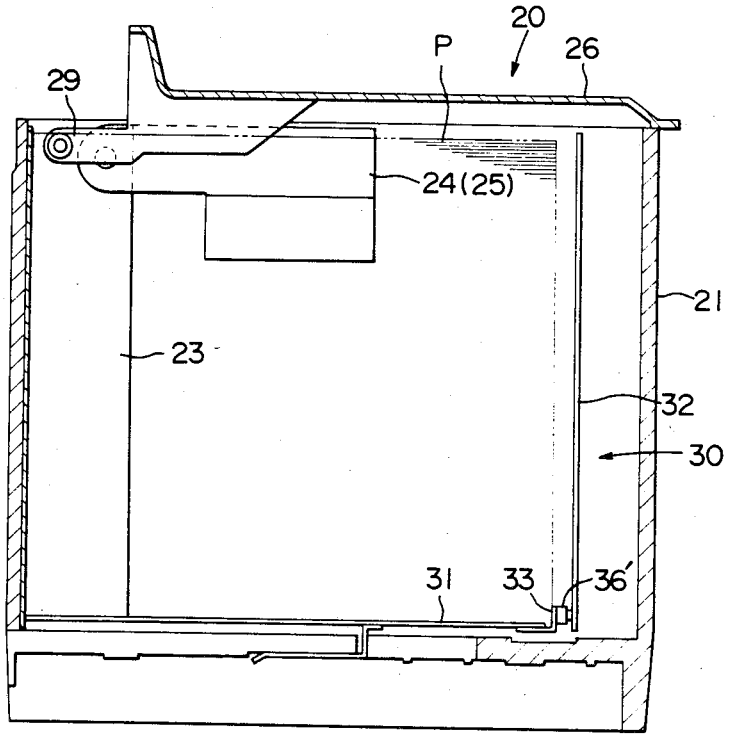
FIG. 10 is a sectional view showing the paper container.
Figure 11:
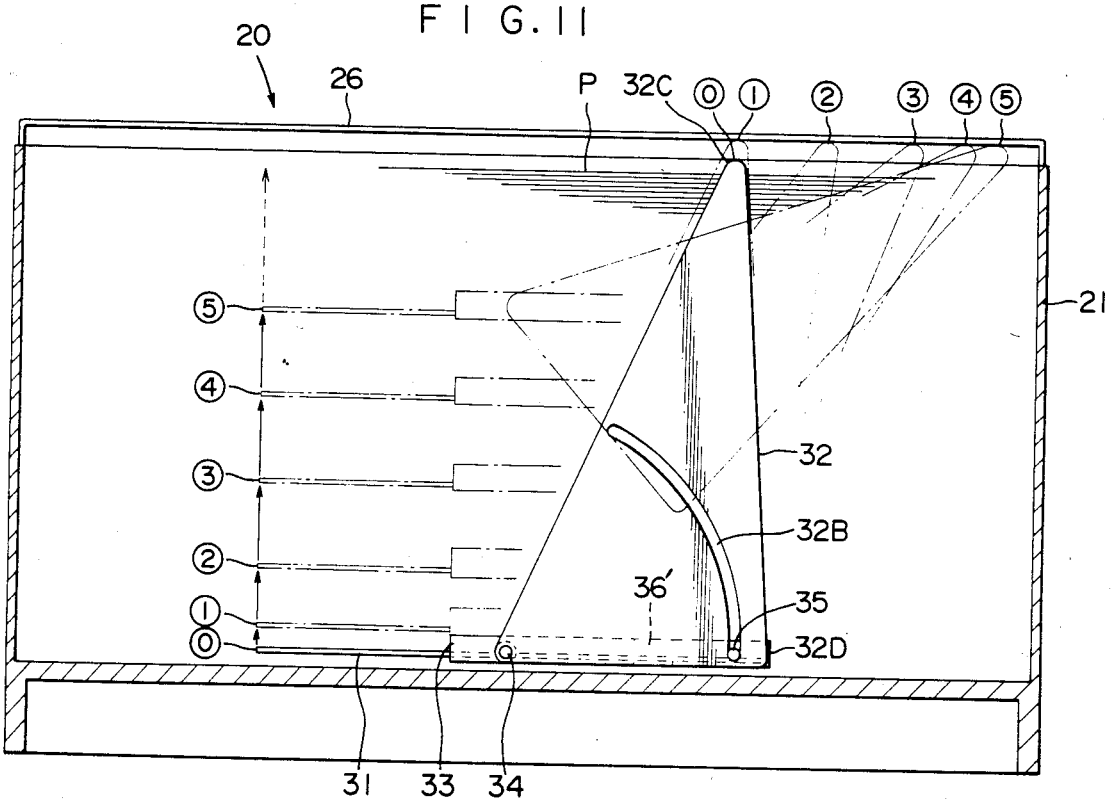
Figure 12:
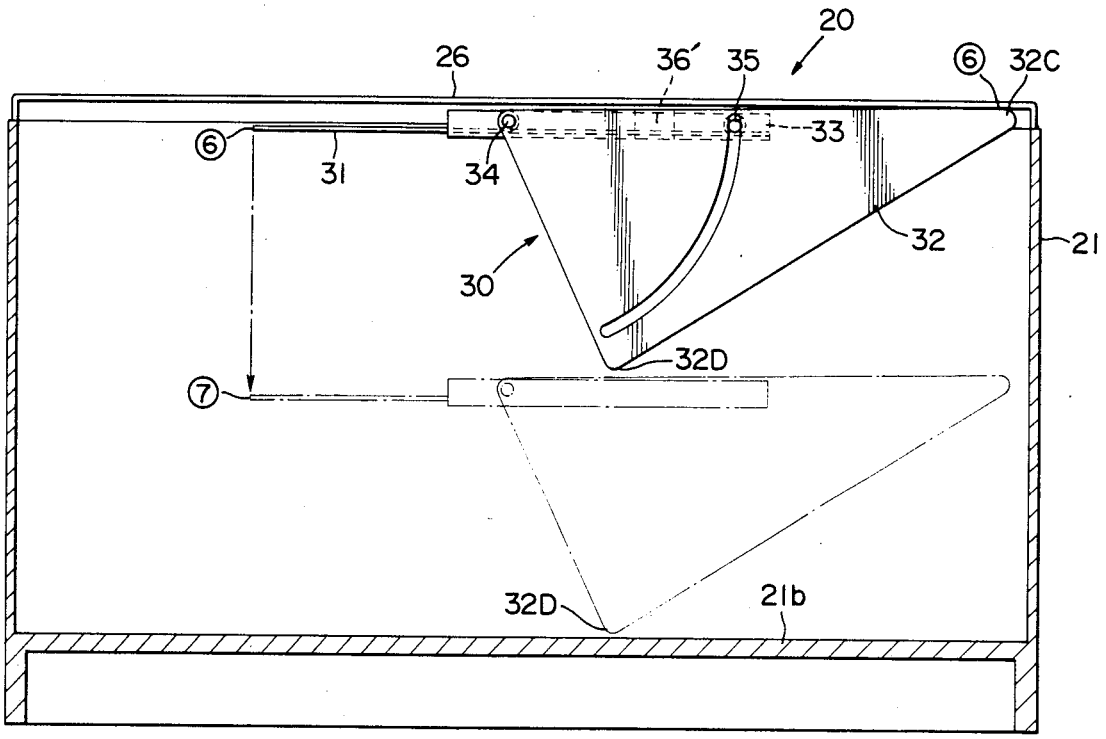
Figure 13:
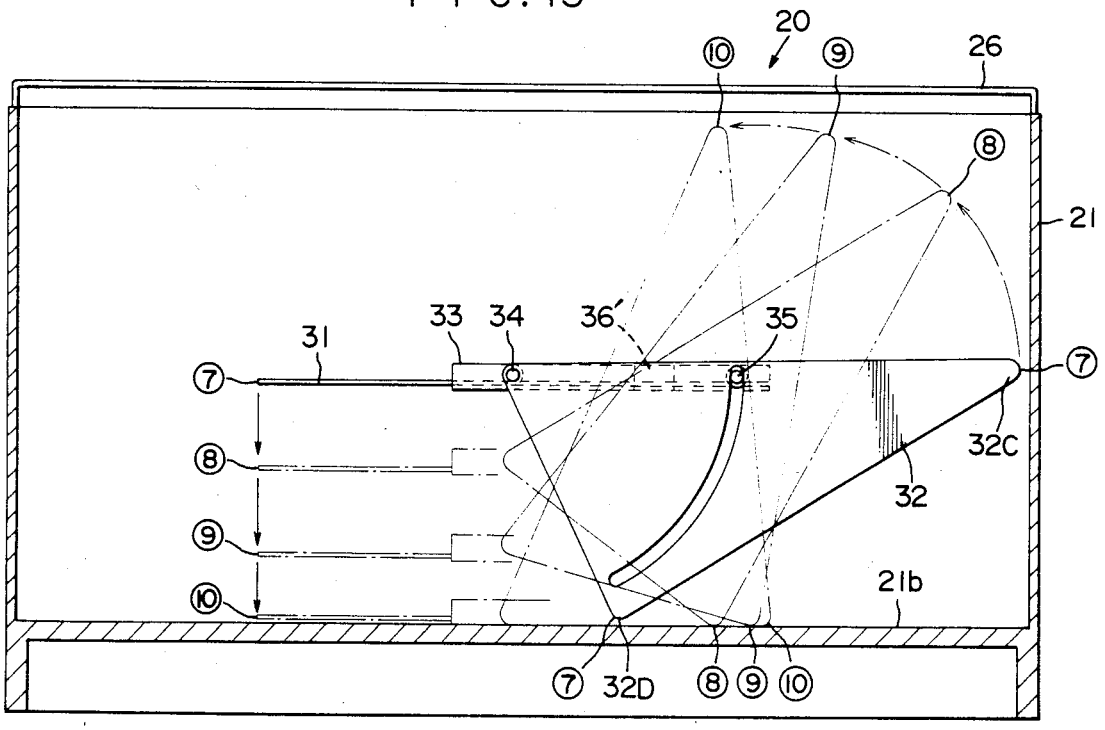

FIGS. 11, 12, and 13 are sections taken from FIG. 10 and showing the lifting process of the backing plate unit in the paper container.

DESCRIPTION OF THE PREFERRED EMBODIMENTS

Figure 1:
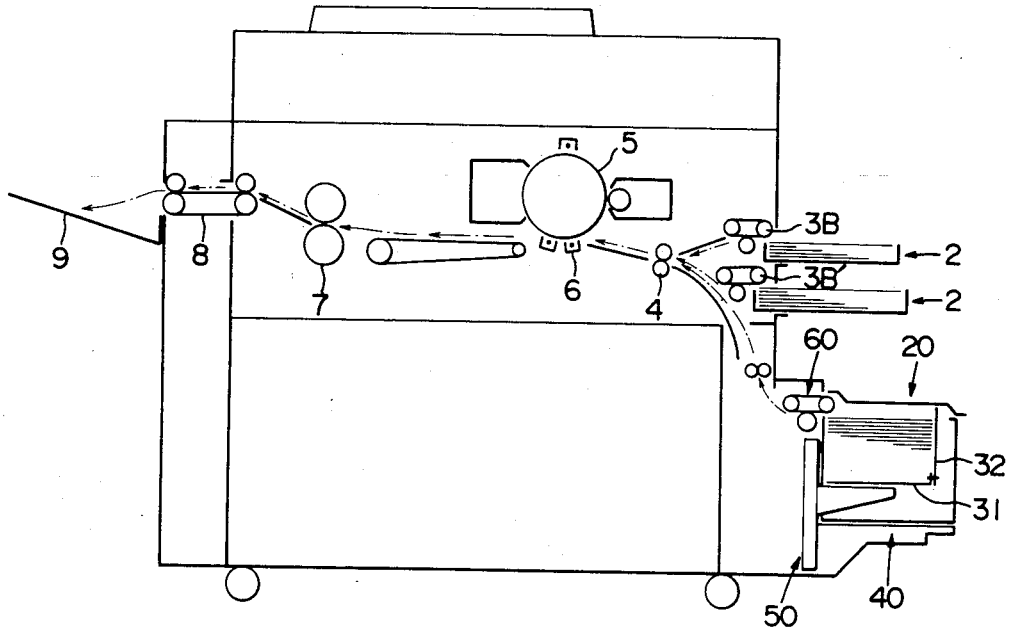
FIG. 1 is a schematic view showing the structure of a copying machine equipped with a paper feeding device according to the present invention.
Figure 8:
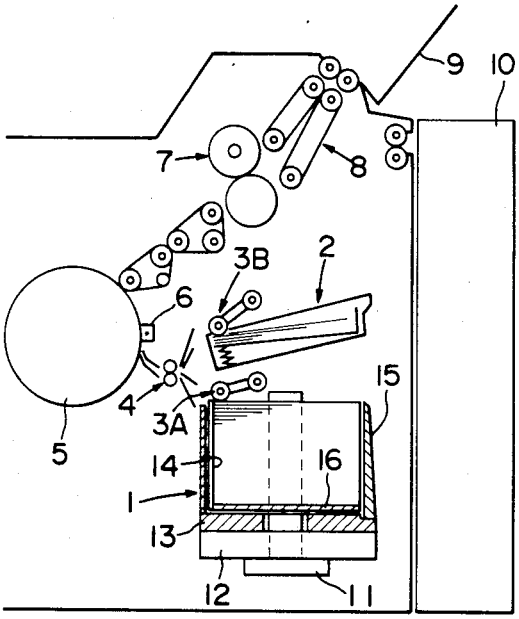
FIG. 8 PRIOR ART
FIG. 8 is a schematic view showing the paper conveyor system of the copying machine equipped with the paper feeding device of the prior art.
Figure 9:
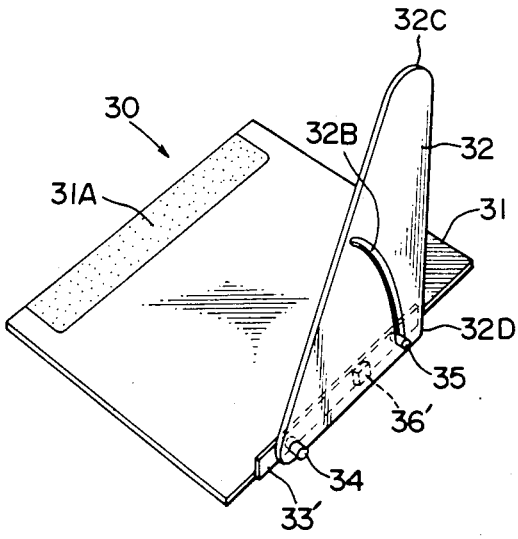
FIG. 9 is a perspective view showing a backing plate unit to be built in a paper container of another embodiment of the present invention.

FIG. 1 is a schematic view showing the structure of a copying machine equipped with the paper feeding device according to the present invention. Single-dotted arrows appearing in FIG. 1 designate the paper conveyor passage of the reproducing machine. Incidentally, the members having the same functions as those of the members appearing in FIG. 8 will be denoted by common reference numerals in the remaining Figures.

FIG. 1: reference numeral 20 denotes a paper container for stocking a great number of, e.g., 1,000 to 3,000 sheets of paper; numeral 40, a mounting unit for mounting the paper container; numeral 50, lifting means; and numeral 60, paper feeding means. These units constitute together the large-capacity paper feeding device which is disposed below the paper feeding cassette 2 for mainly stocking a smaller number of, e.g., 300 to 500 sheets of paper.

Figure 2:
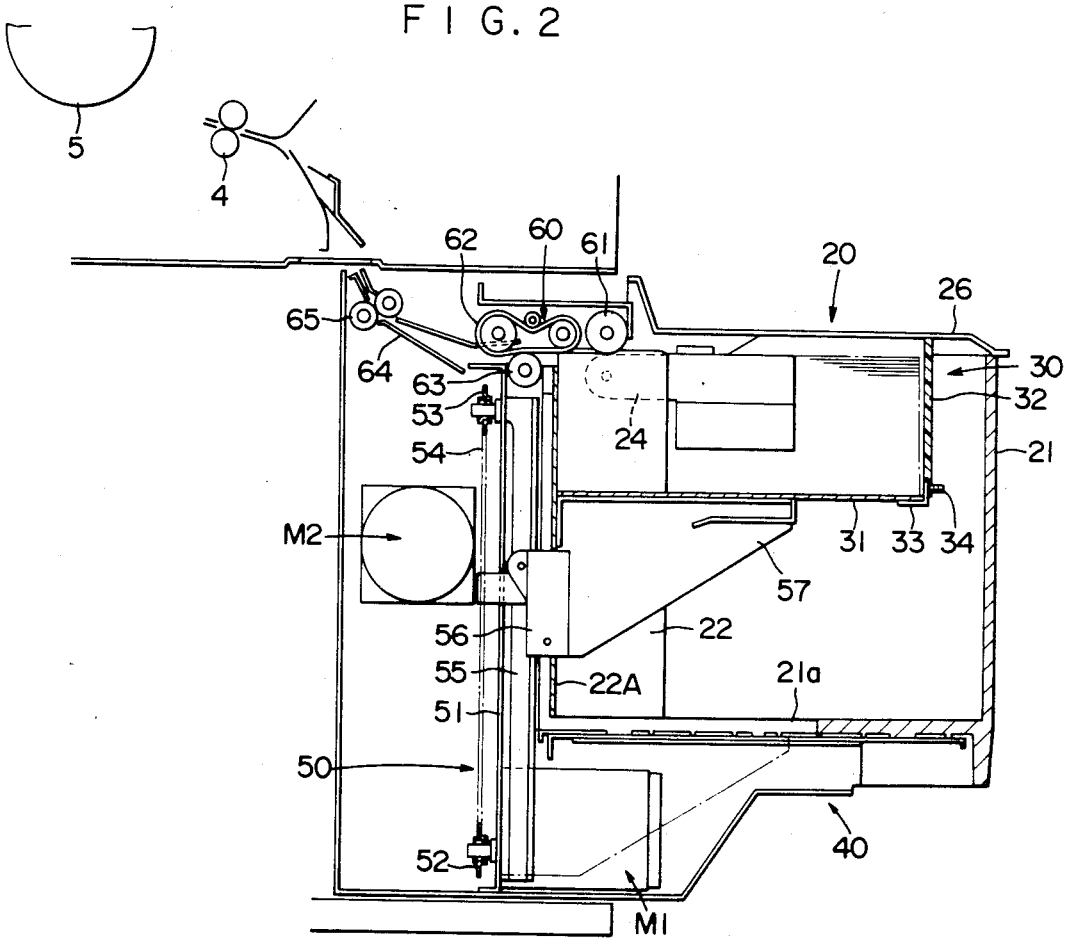
FIG. 2 is a sectional view showing a large-capacity paper feeding device and a conveyor system.
Figure 3:
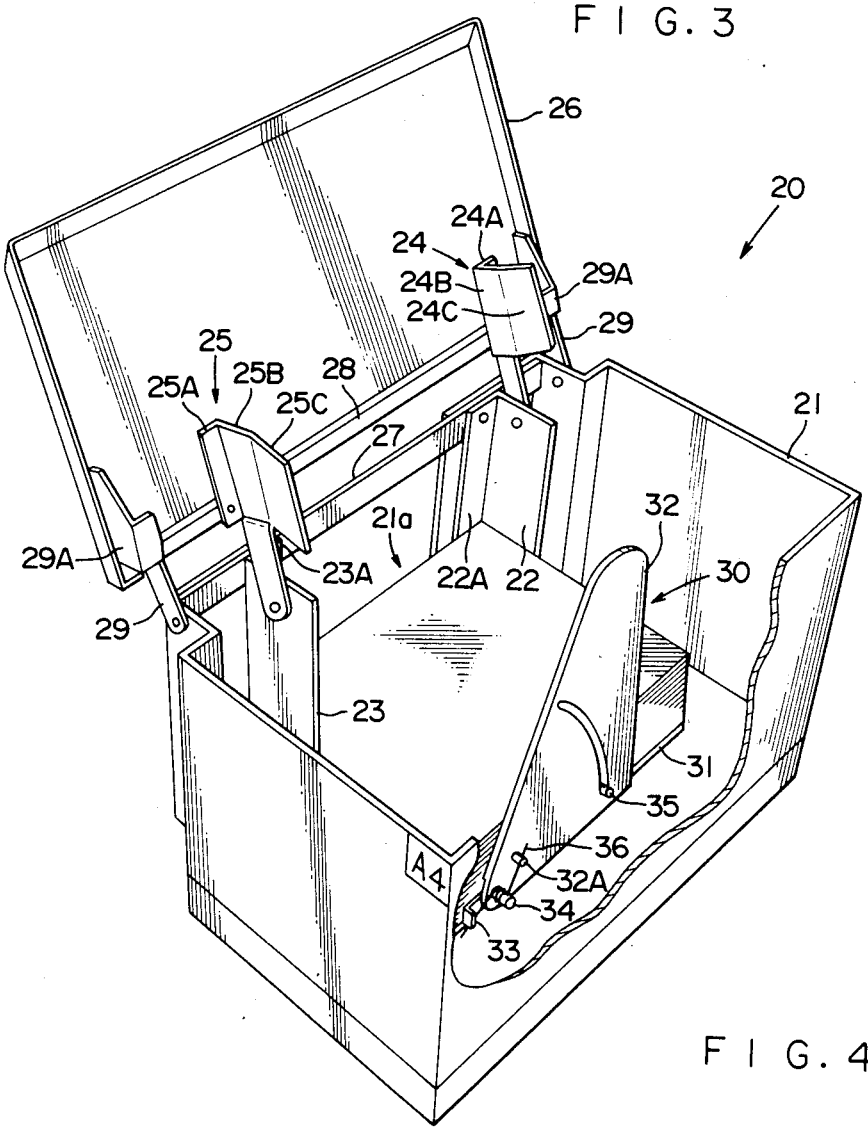
FIG. 3 is a perspective view showing a paper container.

FIG. 2 is a sectional view showing a portion of the aforementioned large-capacity paper feeding device and a paper conveyor system, and FIG. 3 is a perspective view showing the paper container 20.

The paper container 20 is structured of: an outer case 21 having cut-away portions in its front and bottom; fixed side plates 22 and 23 and movable side plates 24 and 25 acting as side regulating members for positioning the widthwise direction of the paper sheaf; a cover 26 for closing the upper opening of the outer case 21; a backing plate unit 30 for backing the paper sheaf having a backing plate 31 and a rear regulating member 32 rotatably engaging with the backing plate 31 for regulating the rear end of the paper sheaf.

The aforementioned outer case 21 is formed in its front, i.e., on the side in the vicinity of a paper feeding means 60 with a cut-away portion **21*a* for allowing a lift bed 57 of a later-described lifting means 50** to pass therethrough.

The fixed side plates 22 and 23 have sides for regulating the width of the paper sheaf and bent portions 22A and 23A for limiting the advancing end of the paper sheaf and are fixed on the bottom of the outer case 21. Moreover, the aforementioned bent portions 22A and 23A are fixed by means of screws to a support plate 27 which overlies the cut-away portion **21*a* of the outer case 21**.

Above the fixed side plates 22 and 23, on the other hand, there are hinged the movable side plates 24 and 25 which can swing. The movable side plates 24 and 25 have bent portions 24A and 25A fixed on another support plate 28 and paper side regulating faces 24B and 25B held at a spacing equal to a predetermined paper width. Incidentally, the paper side regulating faces 24B and 25B are extended to form slightly inclined guide faces 24C and 25C.

The aforementioned support plate 28 has its two ends engaging slidably with hinge members 29. These hinge members 29 are swingably hinged to the front upper portions of the aforementioned outer case 21 and engage with retaining members 29A of the cover 26 to allow the cover 26 to be opened or closed.

Figure 4:
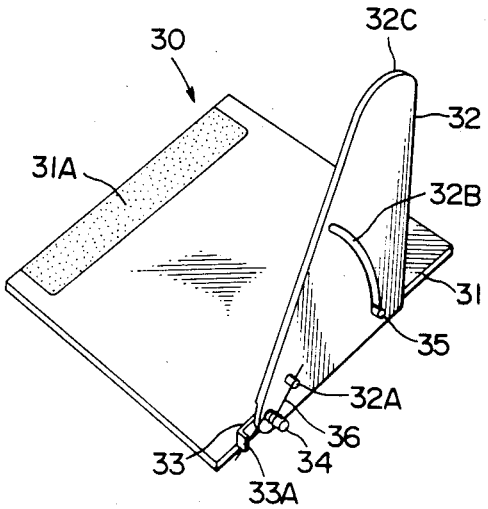
FIG. 4 is a perspective view showing a backing plate unit to be built in the paper container.

FIG. 4 is a perspective view showing the backing plate unit 30 composed of the rear regulating member 32 and the backing plate 31 which are built in the aforementioned paper container 20.

The backing plate 31 is a plate-shaped member for backing the paper sheaf and is formed to have substantially the same size as the paper size. This backing plate 31 can be so placed on the bottom of the outer case 21 as to cover the cut-away portion of the bottom of the outer case 21 and can be moved up and down by the action of the lifting means. Incidentally, a rectangular plate 31A located on the front upper side of the backing plate 31 is a friction member.

On the rear side of the backing plate 31, there is integrally fixed a mounting plate 33 which has a bent portion 33A at its one end and anchors a pivot pin 34 and a pin 35.

On the other hand, the rear regulating member 32 is a plate-shaped member molded of a resin, which is formed in its lower end with a through hole for fitting the aforementioned pivot pin 34 therein. Reference numeral 32A denotes a projection which projects outward from the rear regulating member 32. Numeral 36 denotes a torque spring which has its coil portion wound on the pivot pin 34 and its two straight end portions retained on the bent portion of the mounting plate 33 and the projection 32A so that the rear regulating member 32 is biased to rotate in the counterclockwise direction.

On the other hand, the rear regulating member 32 is formed in the vicinity of its center with an arcuate groove 32B which extends around the pivot pin 34 to slide on the pin 35 anchored at the mounting plate 33. Here, the rotation of the rear regulating member 32 is stopped at its upright position when the lower end of the arcuate groove 32B is brought into pressure contact with the pin 35.

When the crest 32C of the rear regulating member 32 thus made is depressed, it is rocked down clockwise on the pivot pin 34 against the energizing action of the spring. In this downward stroke, the pin 35 slides in the arcuate groove 32B until it is stopped by the upper end of the arcuate groove 32B so that the rear regulating member 32 takes its position of bottom dead center. When the depressing force is released from the crest 32C, the rear regulating member 32 restores its upright position.

Reverting to FIG. 2, the mounting unit 40 is disposed below the paper container 20. The mounting unit 40 comprises a stationary portion fixed on the body of the reproducing machine and a movable portion made movable on rail members. The stationary portion is equipped with the later-described lifting means 50, and the aforementioned paper container 20 is removably carried by the movable portion and is positioned.

The lifting means 50 is structured of: a supporting upright post 51; a motor M1 with a reduction gear attached to the lower portion of the supporting member 51; a lower sprocket 52 fixed on the shaft of the motor M1; an upper sprocket 53 attached rotatably to the upper portion of the supporting member 51; a chain 54 made to run under tension between the lower and upper strockets 52 and 53; a guide post 55 fixed on the back of the supporting member 51; a moving member 56 supported slidably on the guide member 55 and retained by the chain 54; and a lift bed 57 integrated with the moving member 56 and abutting against the backing plate 31 of the paper container 20. Incidentally, the moving member 56 and the lift bed 57 are inserted to freely pass through the cut-away portion 21*a* of the aforementioned outer case 21.

The rotational driving force of the motor M1 drives the chain 54 through the lower sprocket 52 to move up and down the moving member 56, which is fixed to the chain 54, along the guide post 55 thereby to move up and down the lift bed 57 which is integrated with the sliding member 56. Thus, the backing plate 31 and the back regulating member 32 are moved up and down.

The well-known paper feeding means 60 is disposed in the upper portion of the paper feeding device. Here, reference numeral 61 denotes a feed roller; numeral 62, a separating belt; numeral 63, a stretching roller; numeral 64, a guide plate; and numeral 65, a conveyor roller. Of these members, the rotating and running members 61, 62 and 65 are driven by a motor M2.

Figure 5:
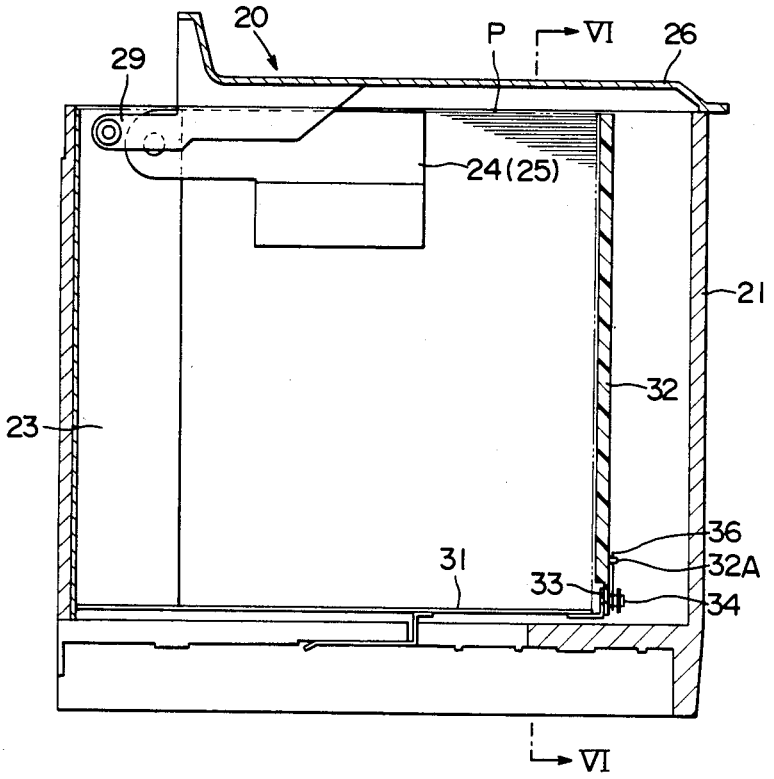
FIG. 5 is a sectional view showing the paper container.
Figure 6:
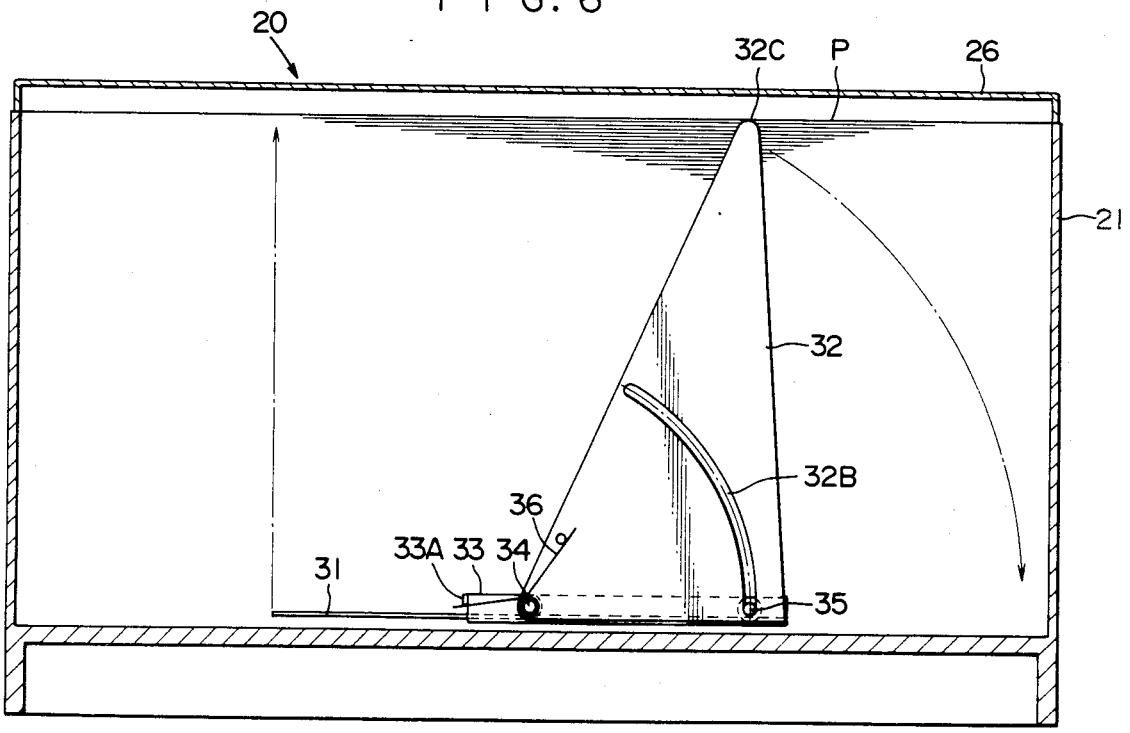
FIGS. 6 and 7 are sections taken along line VI—VI in FIG. 5.
Figure 7:
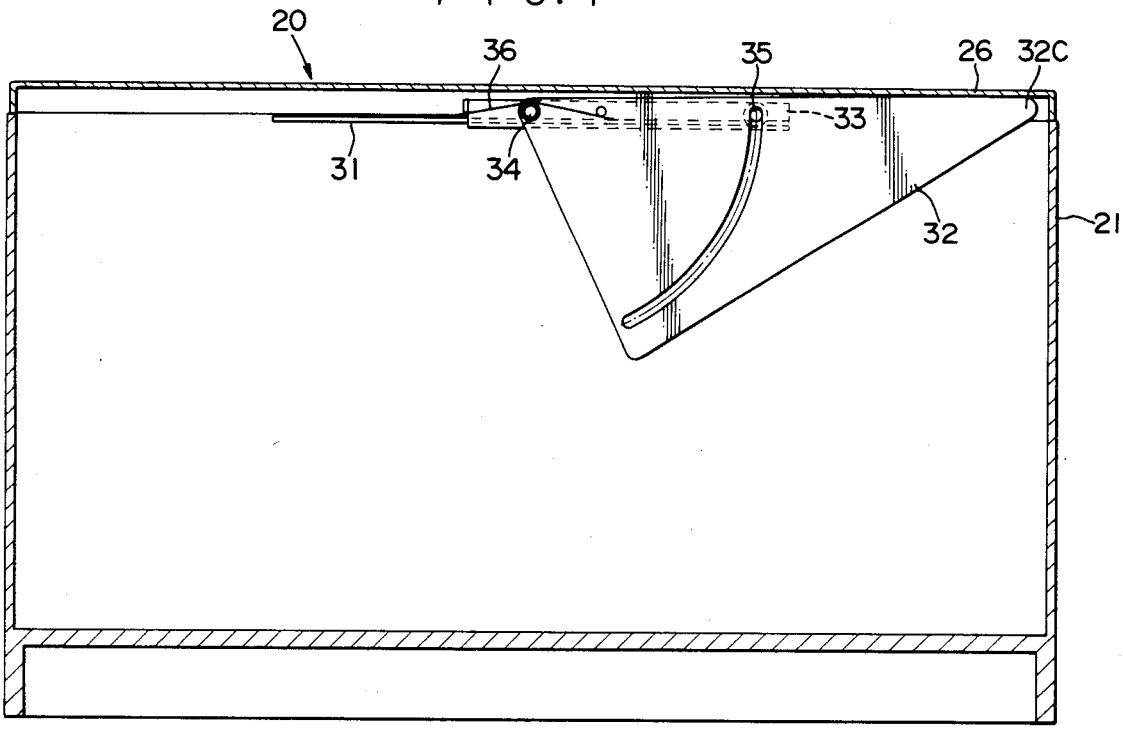

Next, the operations of the paper feeding device according to the present invention will be described in the following. FIG. 5 is a sectional view showing the state in which the backing plate 31 of the aforementioned paper container 20 is in its lowermost position, and FIG. 6 is a section taken along line VI—VI in FIG. 5. Moreover, FIG. 7 is a sectional view showing the state in which the aforementioned backing plate 31 reaches its uppermost position.

When paper P is to be supplied to the paper container 20 or replaced by other paper, the paper container 20 placed on the moving portion of the mounting unit 40 is extracted out to a stop position on the righthand side of the copying machine, as seen in FIG. 2. If a downward button (not shown in the drawing) is then depressed, the motor M1 of the lifting means 50 is started to drive the lift bed 57 to the lowermost position. Simultaneously with this, the backing plate unit 30 in the paper container 20 laid on the lift bed 57 by its own weight is moved down until it is stopped at its lowermost position.

If the cover 26 of the paper container 20 is then opened, the movable side plates 24 and 25 are rocked upward together with the cover 26 so that the two sides of the paper sheaf become almost open. Since, in this state, no external force is applied, the rear regulating member 32 is energized to take its generally upright position by the action of the torque spring 36. In this position,the paper sheaf to be supplied is placed on the backing plate 31.

After this paper supply, the cover 26 is closed. At this time, the movable side plates 24 and 25, each of which has its one end fixed on the supporting plate 28 attached slidably to the cover 26, rock on the pivot pins anchored at the upper portions of the fixed side plates 22 and 23 so that their inclined guide faces 24C and 25C regulate and arrange the two side ends of the paper sheaf and then their paper side regulating faces 24B and 25B come into contact with the two side ends of the paper sheaf to accurately position it.

When the cover 26 completely shuts off the upper opening of the outer case 21, it is engaged by a lock member (not shown in the drawing) so that it is locked by the outer case 21. Simultaneously with this, the motor M1 is started in response to a drive signal to lift the lift bed 57 until it is stopped at a predetermined position when the uppermost paper of the sheaf on the backing plate 31 is detected by detecting means (although not shown in the drawing) of the paper feeding means 60. At this time, the uppermost paper of the sheaf is forced into contact with the paper feeding roller 61 and the separating belt 62.

The paper in the outer case 21, which has been lifted to a proper level by the lifting means 50, is let off one by one by the feed roller 61 and the separating belt 62, which are started in response to a reproduction starting signal. The paper thus let off is fed through the guide plate 64, the conveyor roller 65 and the synchronizing rollers 4 to the photosensitive drum 5, in which it is reproduced.

As the consumption of the paper proceeds, the feed roller 61 contacting with the paper goes down to a predetermined level. When this level is detected, the signal starts again the rotations of the motor M1 to lift the lift bed 57 and the backing plate 31. When a predetermined level is reached, the motor M1 stops its rotations. The operations described above are repeatedly continued while the paper is being fed.

In this lifting stroke of the backing plate 31, the rear regulating member 32 for contacting and regulating the rear end of the paper sheaf is simultaneously lifted. When the crest 32C of the rear regulating member 32 comes into abutment against the inner wall of the cover 26 to have its lift interrupted, it receives a pressure from the rising force of the backing plate 31. If this backing plate 31 further moves up, the rear regulating member 32 has its crest 32C sliding on the inner wall of the cover 26 to move its contacting point rightward and rocks in its entirety clockwise on the pivot pin 34.

When the paper is completely consumed, the paper container 20 and the backing plate unit 30 take the positions shown in FIG. 7 so that the rear regulating member 32 takes its rightmost inclined position. When these positions are reached, a detecting means (not shown in the drawing) operates to display the indication of "No paper" in the display panel of the reproducing machine body, and the motor M1 starts its reverse rotations until it is interrupted when the lift bed 57 reaches its lowermost position. In this state, the paper can be supplied or replaced again.

Different paper containers 20 are prepared for the individual sizes of the paper to be contained. For example, a variety of paper feeding trays for A3 to B5 sizes are prepared, and a special paper feeding tray is mounted on the aforementioned mounting unit when the reproduction is to be made with a great number of sheets of paper of required size reproduced.

In an alternative case in which paper of various sizes are to be stored commonly in one paper feeding tray, the aforementioned side plates 22, 23 24 and 25 are made movable for their position settings, and a variety of backing plate units 30 are prepared for the individual paper sizes so that the outer case may be charged with a special backing plate in an interchangeable manner when necessary paper is to be contained. In this case, the backing plates of the various backing paper units are made to have generally the same shapes as those of the individual paper sizes, and the rear regulating member having generally the same shape as that of the aforementioned one is rotatably attached to each of the backing plates.

Moreover the aforementioned side plates 22 and 23 need not be of the fixed type but may have a movable structure like the rear regulating member.

As has been described hereinbefore, the paper feeding device according to the present invention is structured such that the paper container can be removed from the lifting means, such that the backing plate for backing a great number of sheets of paper to be contained in the paper container can be moved up and down by the lifting means, and such that the rear regulating member for regulating the back end of the paper sheaf on the backing plate can be rocked with respect to the backing plate. As a result, the rear end of the paper sheaf is always held in contact with the rear regulating member in the upward or downward stroke of the backing plate by the lifting means. This prevents the paper sheaf from falling down to pieces. There can be attained an effect to completely eliminate the trouble that the uppermost paper of the sheaf is slipped or turned over by the paper feeding means or the like to allow its rear end to ride over the rear regulating member thereby to deteriorate the paper feed. As a result, another effect is to ensure smooth and accurate feed of paper to the copying machine body.

In another embodiment of the present invention, as shown in FIGS. 9 to 13, a mounting plate 33′ is integrally fixed to the rear side of the backing plate 31. A permanent magnet 36′ is fixed on the central portion of the mounting plate 33′.

On the other hand, the rear regulating member 32 is made of a magnetic material such as an iron plate and is formed into a generally triangular plate member. This rear regulating member 32 has its crest 32C and lower end corner 32D playing the roles of cams for forcibly bringing up and down the rear regulating member 32 by external forces.

When a downward force is applied to the crest 32C of the rear regulating member 32, this member 32 is rocked down clockwise on the pivot pin 34 while being braked by the attraction of the permanent magnet 36′. If the downward force is released in this downward stroke, the rear regulating member 32 is stopped and retained in the released position by the attraction of the permanent magnet 36′.

If an upward force is then applied to the lower end corner 32D of the rear regulating member 32, this member 32 is rocked up counterclockwise on the pivot pin 34. In this upward stroke, too, the backing force by the permanent magnet is applied to the rear regulating member 32 so that this member 32 can be stopped and retained in an arbitrary position.

Incidentally, similar operations can be obtained even if the rear regulating member 32 is molded of a synthetic resin or the like whereas only its sector surface contacting with the permanent magnet 36′ has a magnetic material such as an iron plate joined thereto. Alternatively, similar operations can also be obtained even if a friction plate, a forced contact member or the like is attached in place of the permanent magnet 36′ to the mounting plate 33′ in the vicinity of the leg of the pin 35 to apply a frictional braking force to the rear regulating member 32.

In the upward stroke of the backing plate unit 30, according to this embodiment, the rear regulating member 32 is lifted integrally with the backing plate 31 by the holding force of the permanent magnet 36′ (⓪→①, as shown in FIG. 11). After the crest 32C has come into abutment against the inner wall of the cover 26 in a predetermined position, it slides rightward in a horizontal direction along the inner wall of the cover 26 as the backing plate 31 rises. As a result, the rear regulating member 32 is inclined clockwise on the pivot pin 34 while being held by the attraction of the permanent magnet 36′ (①→②→③→④→⑤, as shown in FIG. 11).

When the paper is completely consumed to the last, the backing plate unit 30 of the paper container 20 has come into its uppermost position shown in FIG. 12 so that the rear regulating member 32 takes its rightmost inclined position ⑥.

In this position, the detecting means operates to display the indication of "No Paper" in the display panel of the reproducing machine body, and the motor M1 starts its reverse rotations so that the lift bed 57 is brought down to stop its lowermost position. As a result, the backing plate unit 30 is also moved down to its lowermost position, in which the paper can be supplied or replaced again.

In this downward stroke of the backing plate unit 30, the rear regulating member 32 is moved in parallel while being held in the position 6 by the attraction of the permanent magnet 36′. When the position 7 shown in FIG. 12 is reached, the lower end corner 32D of the rear regulating member 32 comes into abutment against the inner bottom wall 21*b* of the outer case 21.

As the backing plate unit 30 is uninterruptedly moved down to bring down its backing plate 31 in the course of ⑦→⑧→⑨→⑩, as shown in FIG. 13, the lower end corner 32D of the rear regulating member 32 moves rightward while abutting against the inner bottom wall 21*b* of the outer case 21 so that the rear regulating member 32 is rocked counterclockwise on the pivot pin 34 to restore its initial upright position. In this downward stroke of the backing plate unit 30, too, this member 32 is rocked, while being held by the permanent magnet 36′, to cause no planar deflection.

According to this embodiment of the present invention, the rear regulating member is forced to rise and fall down by the respective inner walls of the outer case and the cover and is prevented in its upward and downward strokes from any planar deflection by the friction member such as the permanent magnet so that the rear regulating member can operate smoothly and reliably to stabilize its regulations of the rear ends of the paper.

What is claimed is:

1. A paper feeding device comprising:

lifting means for lifting to a predetermined position a backing plate for carrying papers thereon;

paper container means having a movable cover;

a rear regulating member mounted on said backing plate for regulating the rear end of papers carried on said backing plate, said rear regulating member having a crest portion arranged to contact said cover;

rotating means coupled at least to said rear regulating member for permitting rotation of said rear regulating member with respect to said backing plate while the crest portion of said rear regulating member contacts with said cover according to the elevation of said backing plate by said lifting means; and paper feed means for feeding the paper from said paper container means in a substantially horizontal direction.

2. A paper feeding device comprising:

paper carrying means for carrying a stack of a large number of recording papers;

a paper container having said paper carrying means therein;

said paper carrying means comprising a backing plate means which is movable up and down on which said large number of recording papers are mounted, and a rear regulating member coupled to said backing plate means and being arranged for regulating the rear end of substantially an entire stack of said recording papers carried on said backing plate means; and p1 said rear regulating member being movably coupled to said backing plate means so as to assume a substantially upright position extending above said backing plate means to regulate said rear end of said stack of recording papers when said backing plate means is in a lower position, and assuming successively lowered positions responsive to said backing plate means rising above said lower position, said rear regulating member regulating said rear end of said stack of recording papers throughout the movement of said backing plate means from its lowermost position to its uppermost position.

3. A paper feeding device according to claim 2, wherein said rear regulating member is pivotally ooupled to said backing plate means.

4. A paper feeding device according to claim 3, further comprising biasing means coupled to said rear regulating member for biasing said rear regulating member toward an upright position, said rear regulating member pivoting downward against the force of said biasing means responsive to engagement of said rear regulating member with a body portion of said paper container during upward movement of said backing plate.

5. A paper feeding device according to claim 4, wherein said body portion of said paper container is a cover thereof.

6. A paper feeding device according to claim 4, wherein said biasing means comprises a spring means.

7. A paper feeding device according to claim 5, wherein said rear regulating member has a crest portion which engages with said cover of said body of said paper container during upward movement of said backing plate.

8. A paper feeding device according to claim 4, wherein said rear regulating member has a crest portion which engages with said body portion of said paper container during upward movement of said backing plate.

9. A paper feeding device according to claim 2, further comprising friction means coupled to at least one of said backing plate means and said rear regulating member for frictionally engaging the other of said rear regulating member and backing plate means during pivotal movement of said rear regulating member relative to said backing plate means and for releasably maintaining said rear regulating member in position relative to said backing plate means.

10. A paper feeding device according to claim 9, wherein said friction means comprises a permanent magnet mounted on at least one of said backing plate means and rear regulating means, and wherein the other of said rear regulating member and backing plate means comprises at least a surface portion made of magnetic material which is in contact with said permanent magnet so as to provide friction retention of said regulating member in position.

11. A paper feeding device according to claim 10, wherein said magnet is mounted on said backing plate means, and said rear regulating member comprises said surface portion of magnetic material.

12. A paper feeding device according to claim 9,, wherein said rear regulating member includes means for abutting against an inner wall surface of said paper container so as to provide a slidable frictionable movement of said rear regulating member during movement of said backing plate.

13. A paper feeding device according to claim 9, wherein said friction means is coupled to said backing plate means.

14. A paper feeding device comprising:

lifting means for lifting to a predetermined position a backing plate for carrying papers thereon;

paper container means;

a rear regulating member mounted on said backing plate for regulating the rear end of papers carried on said backing plate, said rear regulating member having an engaging portion arranged to engage a portion of said paper container means;

rotating means coupled at least to said rear regulating member for permitting rotation of said rear regulating member with respect to said backing plate while said engaging portion of said rear regulating member engages with said portion of said paper container means according to the elevation of said backing plate by said lifting means; and paper feed means for feeding the paper from said paper container means in a substantially horizontal direction.

* * * * *